US005174076A

United States Patent [19]

Schiedegger et al.

[11] Patent Number: 5,174,076

[45] Date of Patent: Dec. 29, 1992

[54] RIDGE VENT FOR HIP ROOF

[75] Inventors: Charles E. Schiedegger, Metamora; Aundrea K. Lamecki; Jeffery E. Schiedegger, both of Attica, all of Mich.

[73] Assignee: Mid-America Building Products Corporation, Detroit, Mich.

[21] Appl. No.: 786,558

[22] Filed: Nov. 1, 1991

[51] Int. Cl.[5] ..... F24F 7/00; E04B 7/00; E04D 1/30

[52] U.S. Cl. ..... 52/199; 52/57; 454/365

[58] Field of Search ..... 52/199, 57; 454/356, 454/365

[56] References Cited

U.S. PATENT DOCUMENTS

| | | | |
|---|---|---|---|
| 4,280,399 | 7/1981 | Cunning | 454/365 |
| 4,325,290 | 4/1982 | Wolfert | 454/365 |
| 4,554,862 | 11/1985 | Wolfert | 454/365 |
| 4,924,761 | 5/1990 | MacLeod | 454/365 |
| 5,009,149 | 4/1991 | MacLeod | 454/365 |

*Primary Examiner*—Richard E. Chilcot, Jr.
*Assistant Examiner*—Beth A. Aubrey
*Attorney, Agent, or Firm*—Barnes, Kisselle, Raisch, Choate, Whittemore & Hulbert

[57] ABSTRACT

A ridge vent for a hip roof comprising a one piece plastic body including a base wall having transversely spaced rows of integral vanes extending from one surface thereof. The vanes of adjacent rows are positioned such that the vanes define a sinuous path. Preferably, one of each of the rows has the wings extending at an acute angle to the axis of the walls and the other row or each set of rows has the wings extending at an oppositely directed acute axis to the longitudinal axis of the wall toward the wings of the one row. Thus, air is vented through sinuous paths outwardly when the vent is positioned with the wings engaging the roof and the base wall spaced from the roof. A wall is provided over the free ends of the wings and includes a longitudinally extending portion that extends from the wall toward the base wall. The vent is oriented such that the wings in the outermost row of wings extend downwardly and outwardly when the vent is positioned on the ridge of a hip roof, such that when the roof vent is applied to a hip roof and is subjected to transverse winds, water and snow will be deflected from entry into the building.

11 Claims, 3 Drawing Sheets

RIDGE VENT FOR HIP ROOF

This invention relates to roof vents and particularly to roof vents for use on hip roofs.

BACKGROUND AND SUMMARY OF THE INVENTION

It has heretofore been known that it is desirable to provide means for ventilating a roof. Typical patents that have been heretofore suggested are, for example, U.S. Pat. Nos. 2,799,214, 3,236,170, 3,949,657, 4,280,399, 4,325,290 and 4,554,862.

In U.S. Pat. Nos. 4,924,761 and 5,009,249, there is disclosed a roof vent comprising a one piece plastic body including a base wall having transversely spaced rows of integral vanes extending from one surface thereof. The vanes of adjacent rows are positioned such that the vanes define a sinuous path. Preferably, one of each of the rows has the wings extending at an acute angle to the axis of the wall and the other row or each set of rows has the wings extending at an oppositely directed acute axis to the longitudinal axis of the wall toward the wings of the one row. Thus, air is vented through sinuous paths outwardly when the vent is positioned with the wings engaging the roof and the base wall spaced from the roof. Water and snow are prevented by the wings from entry beneath the vent into the building. A wall is provided over the free ends of the wings and includes a longitudinally extending portion that extends from the wall toward the base wall such that when the roof vent is applied to a hip roof and is subjected to transverse winds, water and snow will be deflected from entry into the building.

When such a roof vent is applied to a hip roof, there may be a possibility that water or snow blown in laterally by the inclined hip roof may enter the building.

Accordingly, among the objectives of the present invention are to provide a ridge vent for a hip roof that is particularly adapted to be used either with a horizontal ridge or with an inclined or hip ridge as in hip roofs; wherein the roof vent can be readily adapted to be used on hip roofs; and wherein the adaptation can be achieved at low cost.

In accordance with the invention, the ridge vent for a hip roof comprises a one piece plastic body including a base wall having transversely spaced rows of integral vanes extending from one surface thereof. The vanes of adjacent rows are positioned such that the vanes define a sinuous path. Preferably, one of each of the rows has the wings extending at an acute angle to the axis of the wall and the other row or each set of rows has the wings extending at an oppositely directed acute axis to the longitudinal axis of the wall toward the wings of the one row. Thus, air is vented through sinuous paths outwardly when the vent is positioned with the wings engaging the roof and the base wall spaced from the roof. Water and snow are prevented by the wings from entry beneath the vent into the building. A wall is provided over the free ends of the wings and includes a longitudinally extending portion that extends from the wall toward the base wall. The vent is oriented such that the wings in the outermost row of wings extend downwardly and outwardly when the vent is positioned on the ridge of a hip roof, such that when the roof vent is applied to a hip roof and is subjected to transverse winds, water and snow will be deflected from entry into the building.

DESCRIPTION

Figure 1:
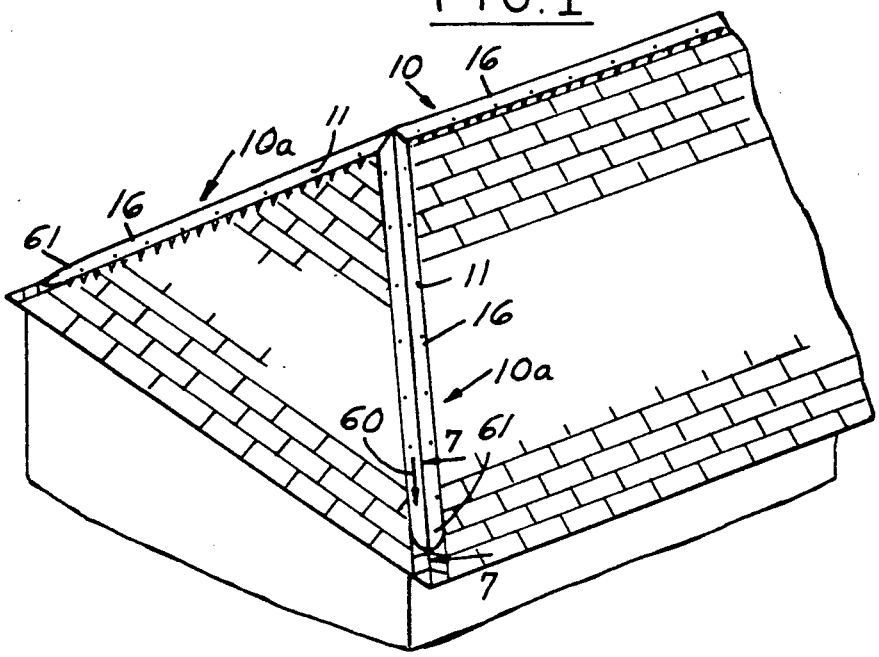
FIG. 1 is a fragmentary perspective view of a building including roof vents on a horizontal ridge and on an inclined ridge, the latter being of the type found in roofs.
Figure 2:
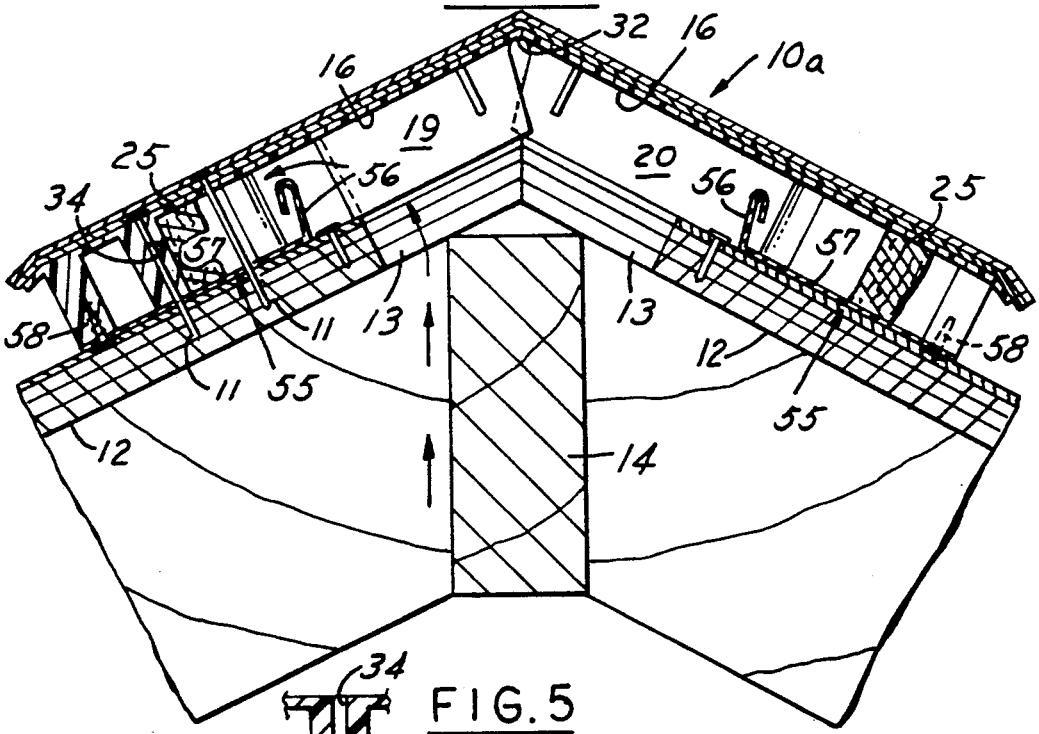
FIG. 2 is a sectional view taken along the lines 2—2 in FIG. 4.

Referring to FIGS. 1 and 2, the roof vent 10 embodying the invention is adapted to be mounted on the ridge of a roof by nails 11 in order that the interior of the building may be vented. In accordance with well known construction, portions of the roof walls 12 are cut away as at 13 adjacent the ridge board 14 and the vent 10 is positioned over the shingles on the roof walls 12 and over the opening 13. Subsequently, sections of roofing or shingle material 15 are provided over the vent in overlapping relation, if desired over the roof vent. Similar vents 10*a* are provided along the ridges of the hip roof.

Figure 4:
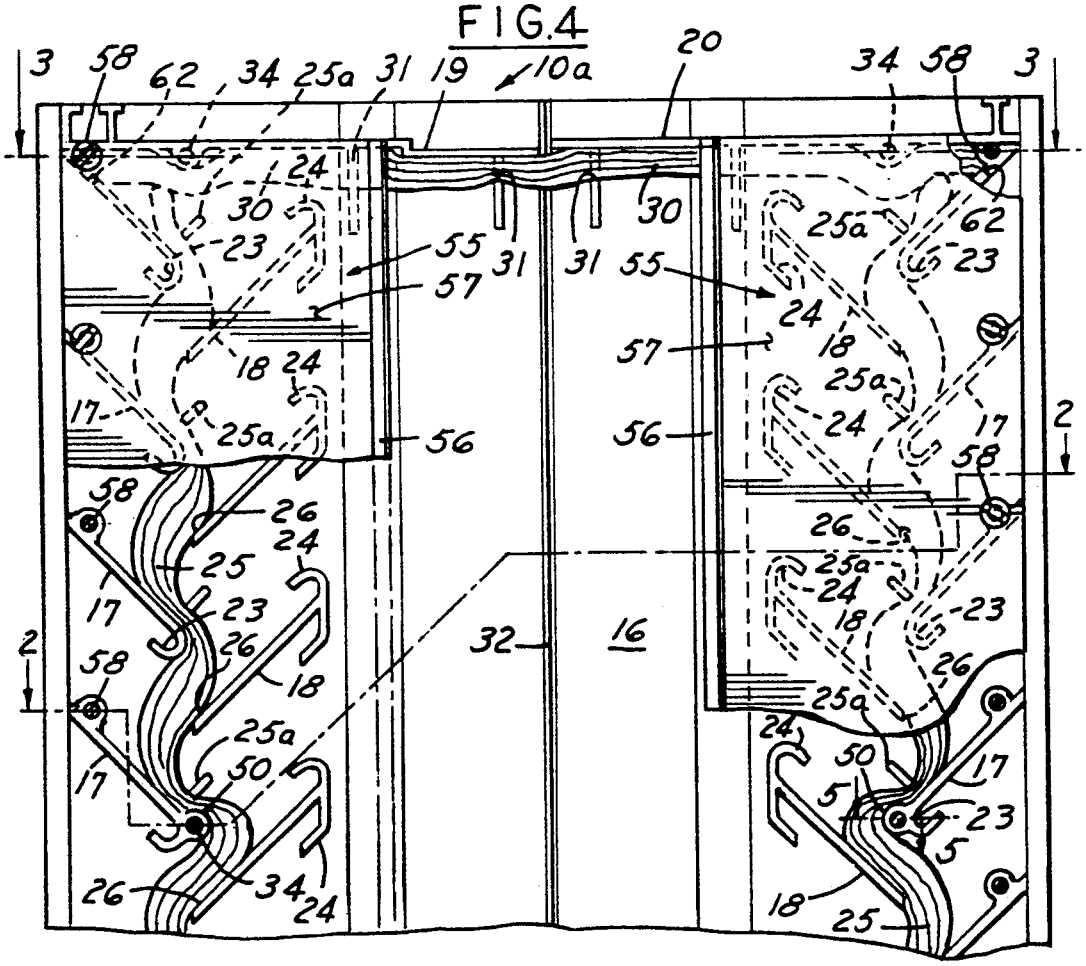
FIG. 4 is a bottom plan view of a roof vent embodying the invention.
Figure 6:
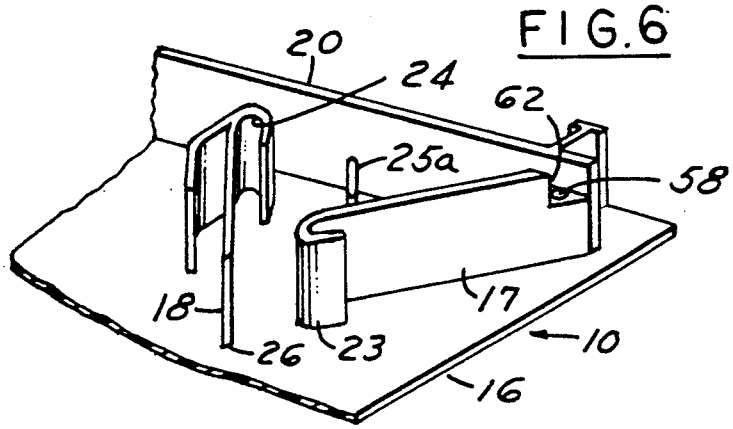
FIG. 6 is a fragmentary perspective view of a portion of the vent.

In accordance with the invention, the ridge vent 10*a* comprises a one piece plastic body which is molded preferably by injection molding and includes a base wall 16 from which a plurality of rows of wings 17, 18 extend in generally perpendicular fashion from the wall 16. In addition, the vent 10*a* includes end walls 19, 20 that are molded integrally with the base wall 16 and extend outwardly in relatively longitudinally spaced relation for purposes presently described. Each set of the wings 17, 18 is provided in two rows along the longitudinal edges of the base wall 16 (FIG. 4), the wings 17, 18 being identical except that the row of wings 17 in the outermost row are in longitudinally spaced parallel relation and the wings 18 in the innermost row are in longitudinally spaced relation such that the plane of the wings or rows 17 intersects the plane of the wings 18. In addition, each of the wings 17 is provided with a curved end 23 as are the wings 18 provided with a curve end 24. The curved ends 23, 24 function to entrap water and snow that may be blown inwardly by wind.

Further, a layer 25 of foraminous material such as open cell foam plastic is interposed between the adjacent ends 23 and 26 of the wings 17, 18 and functions to prevent insects from entering the building while permitting air to exit from under the roof. Preferably, the layers 25 are held in position by integral pins 25*a* that extend from inner surface of the base wall 16.

Similarly, a layer 30 of nonporous plastic material is provided adjacent each end of the walls 19–20 and is held in position by projections 31 that extend from the surface of the wall to prevent the entry of insects as well as air and moisture through the end walls.

Figure 5:
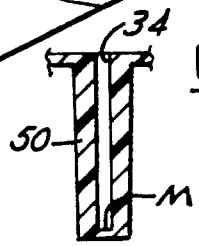
FIG. 5 is a fragmentary sectional view of a portion of the vent.
Figure 3:
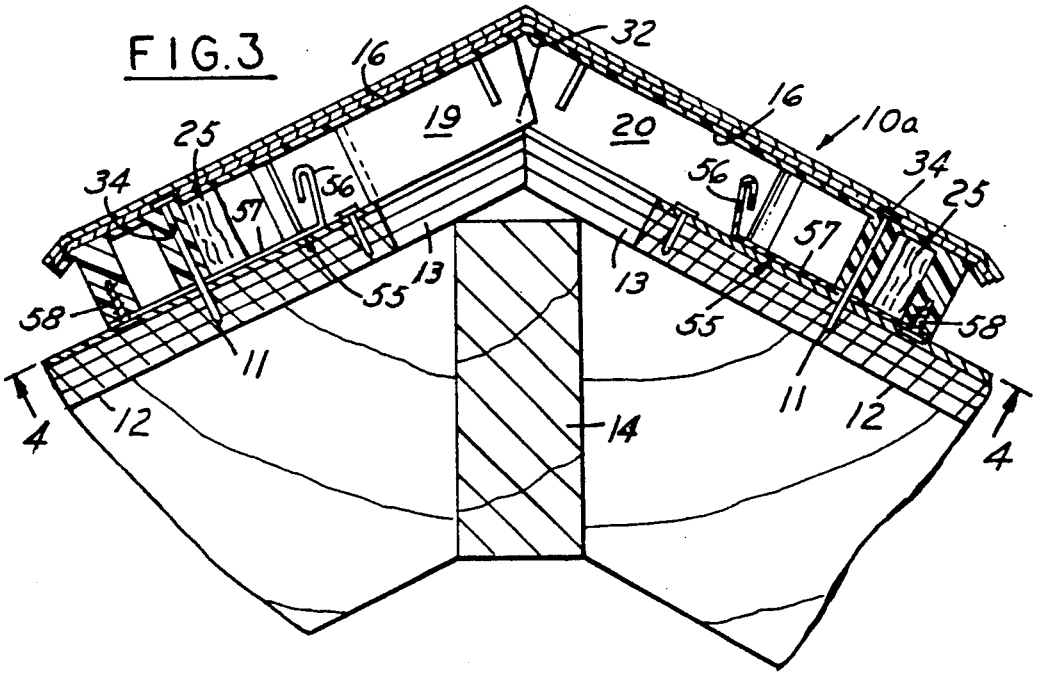
FIG. 3 is a sectional view taken along the lines 3—3 in FIG. 4.

The base wall 16 is formed with portion 32 that extend longitudinally and have a thinner cross section so that the user can bend the wall 16 to the desired angle for conforming the roof vent to the angle of the roof members 12. After such a conformation, the nails 11 can be driven through openings 34 to mount the vent in position on the roof. As shown in FIG. 5, a membrane M of thinner cross section closes the elongated openings 34 such that only a portion of the elongated opening will be pierced by the nail 11 thus minimizing any chance of moisture or rain from entering through the openings that are formed by the piercing. Walls 50 are provided against each opening 34 opposite each wing 18. When a nail 11 is driven, the wing 18 and adjacent wall 50 cooperate to absorb the force of the hammer on the base wall 16 preventing deformation of the back wall 16 as might occur if the portion were not supported. Thus, the pleasing appearance of the roof vent is facilitated.

The above construction is substantially similar to that shown in U.S. Pat. Nos. 4,924,761 and 5,009,149, incorporated herein by reference.

In accordance with the invention, a separate wall 55 is provided on the vent 10*a* and engages the free ends of the wings. The wall extends longitudinally out of the ridge vent and includes a deflector wall 56 extending transversely and having a return portion 57. The wall element 55 is attached by screws 58 that extend through openings molded in the roof vent. The vent 10*a* includes indicia 60 in the form of words and an arrow to indicate to the user that the vent 10 should be oriented such that the wings in the outermost row of wings extend downwardly and outwardly when the vent 10*a* is positioned on the ridge of a hip roof.

Figure 7:
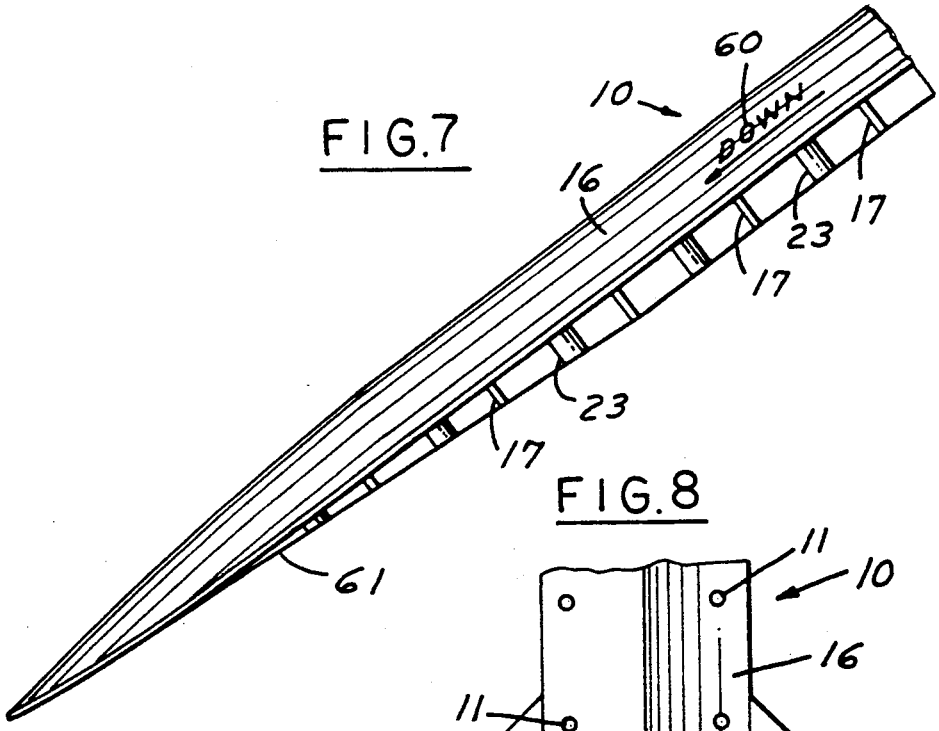
FIG. 7 is a fragmentary sectional view on an enlarged scale taken along the line 7—7.

In addition, a portion of the vent or a separate piece 61 is provided with a tapered end (FIG. 8) and the wings have thin free edges tapered as shown in FIG. 7. This portion is not provided with a wall 56, but is nailed in position.

Figure 8:
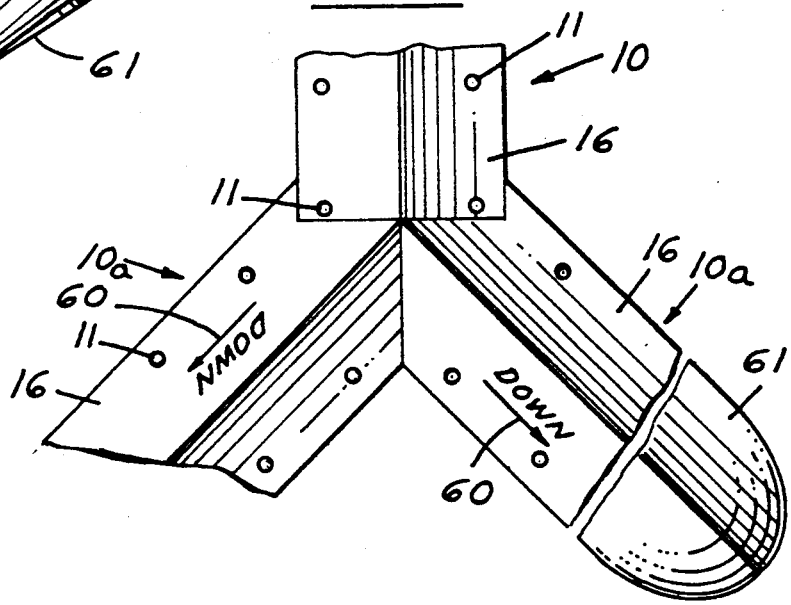
FIG. 8 is a fragmentary plan view of a portion of the roof ridge vent and ridge vents for hip roofs shown in FIG. 1.

As can be seen in FIG. 8, the upper portions of the vents 10*a* can be cut away to form a joint with the roof vent 10.

It can be appreciated that if the ridge of the hip roof is long, a plurality of vents 10*a* can be provided which do not have a tapered end 61 and the lowermost vent 10*a* can have a tapered end. Alternatively, the taper portion may be a separate piece. When the vents 10*a* have a transverse wall, a drain opening 62 is provided for draining rain or melted snow.

When the vent 10*a* is applied, it will function such that when the snow blown inwardly between the base wall and the added wall is deflected and prevented from entering into the opening of the building which is being vented along a hip roof.

It can thus be seen that there has been provided a ridge vent for a hip roof that is particularly adapted to be used either with a horizontal ridge or with an inclined or hip ridge as in hip roofs; wherein the roof vent can be readily adapted to be used on hip roofs; and wherein the adaptation can be achieved at low cost.

We claim:

1. A vent for a hip roof comprising a one piece plastic body including a base wall having transversely spaced rows of integral wings extending from one surface thereof in a direction generally perpendicular thereto, wherein the wings have free edges, inner ends and outer ends, a separate wall provided over the free edges of the wings and including a longitudinally extending portion that extends from the wall toward the base wall and located adjacent the inner ends of the wings, wherein the longitudinally extending portion terminates in spaced relation to the base wall such that when the vent is applied to a hip roof and is subjected to transverse winds, water and snow will be deflected from entry into the building.

2. The vent set forth in claim 1 including indicia on said vent indicating that the vent should be oriented such that the wings extend downwardly and outwardly.

3. The vent set forth in claim 1 comprising spaced pairs of rows of wings one of each of the rows has the wings extending at an acute angle to the axis of the wall and the other row or each set of rows has the wings extending at an oppositely directed acute axis to the longitudinal axis of the wall toward the wings of the one row, and air is vented through sinuous paths outwardly when the vent is positioned with the wings engaging the roof and the base wall spaced from the roof.

4. The vent set forth in claim 3 including indicia on said vent indicating that the vent should be oriented such that the wings extend downwardly and outwardly.

5. The vent set forth in claim 1 wherein said vent is provided with a drain opening at the end thereof which is to be lowest on the ridge of the hip roof.

6. The vent set forth in any one of claims 1-5 including a tapered end portion terminating in a tapered end and having said free edges of said wings tapering toward the tapered end portion.

7. The vent set forth in claim 6 wherein said tapered end portion is integral with said plastic body.

8. The vent set forth in claim 6 wherein said tapered end portion comprises a separate body.

9. A vent for a hip roof comprising a one piece plastic body including a base wall having transversely spaced rows of integral wings extending from one surface thereof in a direction generally perpendicular thereto, wherein the wings have free edges, inner ends and outer ends, and said base wall having a tapered end portion terminating in a tapered end, said wings in said tapered end portion being of progressively decreasing height toward the end of said taper end portion.

10. The vent set forth in claim 9 wherein said tapered end portion is integral with said plastic body.

11. The vent set forth in claim 9 wherein said tapered end portion comprises a separate body.

* * * * *